United States Patent [19]

Leffelman

[11] 4,136,976

[45] Jan. 30, 1979

[54] STATIC MIXING DEVICE

[75] Inventor: Victor C. Leffelman, Oak Forest, Ill.

[73] Assignee: Nalco Chemical Company, Oak Brook, Ill.

[21] Appl. No.: 799,483

[22] Filed: May 23, 1977

[51] Int. Cl.[2] ..... B01F 5/06

[52] U.S. Cl. ..... 366/336; 210/335; 261/DIG. 72

[58] Field of Search ..... 259/4 R, 4 A, 4 AB, 259/4 AC; 138/37, 38, 40, 42, 43; 181/264, 268, 270, 281; 210/335, 339; 55/91; 261/DIG. 72; 48/180 R, 180 M; 123/141

[56] References Cited

U.S. PATENT DOCUMENTS

| | | | |
|---|---|---|---|
| 867,313 | 10/1907 | Simmons | 259/4 R |
| 1,071,528 | 8/1913 | Rapp | 181/264 |
| 1,460,470 | 7/1923 | Askins | 138/37 X |
| 3,432,994 | 3/1969 | Whiton et al. | 55/91 |
| 3,799,132 | 3/1974 | MacGuire | 138/40 X |

FOREIGN PATENT DOCUMENTS

| | | | |
|---|---|---|---|
| 652290 | 10/1928 | France | 138/38 |
| 1014499 | 12/1965 | United Kingdom | 181/264 |

*Primary Examiner*—Philip R. Coe

*Attorney, Agent, or Firm*—John G. Premo; Robert A. Miller; Lloyd L. Zickert

[57] ABSTRACT

An improved mixing device which comprises a cylinder having an inlet and an outlet and contained within the cylinder a plurality of hollow spheres having openings all about their surfaces.

4 Claims, 1 Drawing Figure

STATIC MIXING DEVICE

INTRODUCTION

Figure 1:
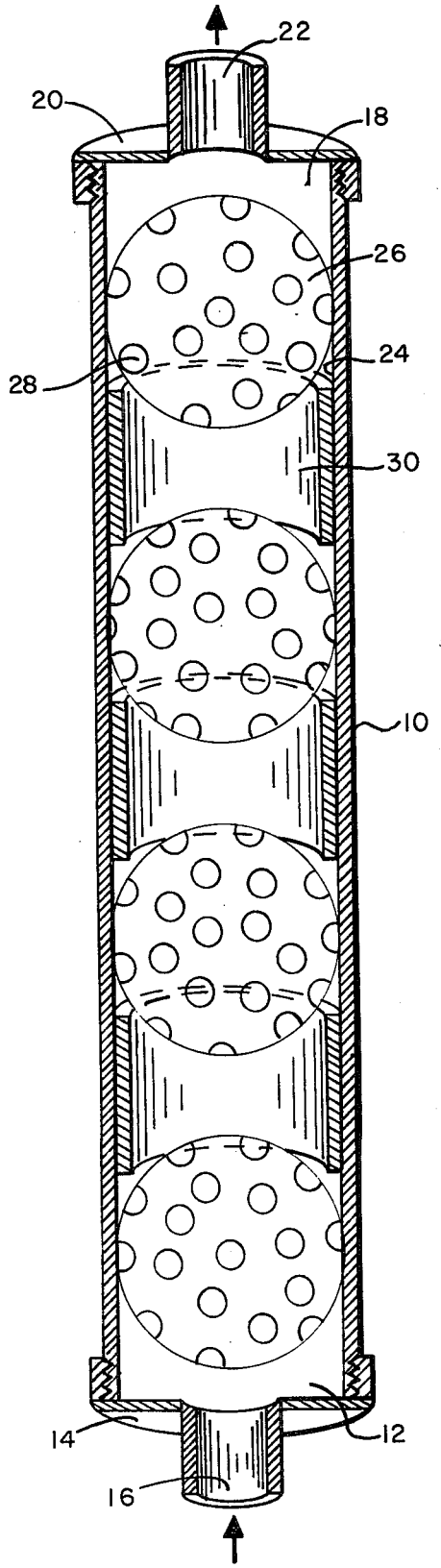

This invention is directed to a simple, easily constructed device for mixing two liquids or a liquid and a solid or a gas. Its construction is simple.

THE DRAWING

The drawing shows the mixing device of the invention in the form of a vertical cutaway view.

THE INVENTION

With specific reference to the drawing, the mixing device of the invention comprises a cylinder 10 having its bottom 12 fitted with a threaded cap 14 which contains an inlet 16. The top 18 is similarly fitted with a threaded cap 20 which contains an outlet 22.

Contained within the inner walls 24 of the cylinder and having an exterior diameter slightly less than the interior diameter of the cylinder are at least two and, preferably, a plurality of hollow spheres 26. These spheres contain a large number of openings 28 which communicate with the interior of the sphere. The spheres may be constructed of any chemically inert material such as stainless steel although, preferably, they are fabricated from a resilient material such as polyethylene, polytetrafluoroethylene and the like. The outer diameter of the spheres corresponds generally to the interior diameter of the cylinder so that they may be placed therein without using excessive force. When resilient materials are employed to fabricate the spheres, they should fit within the cylinder in a rather loose sliding relationship with respect to the interior diameter or walls of the cylinder.

In a preferred embodiment of the invention, the hollow spheres 26 are positioned within the cylinder 10 and kept in spaced apart relationship by means of annular spacers 30. This spacer can be made from pipe nipples. This spacer's outer circumference corresponds generally to the inner diameter of the cylinder.

In operation, the liquids or the liquid solid or gas to be mixed or diluted with another liquid are previously metered into a process line (not shown) which is connected to inlet 16. The fluid initially fills up the cylinder and then establishes a positive pressure therewithin. When the hollow spheres are made of a resilient material, they tend to be compressed, thereby urging them against the inner walls 24 of the cylinder, making them non-moveable. As the fluids to be mixed pass through the openings in the spheres, a great deal of turbulence is developed which then flows in the direction of the arrows where it meets another hollow sphere where additional turbulence is imparted to the liquids or liquid solid systems being mixed. By the time the liquids leave the mixing device through outlet 22, they are thoroughly mixed and ready for ultimate use.

While my mixing device may be constructed from any number of known materials, it is preferable that the cylinder and its caps be fabricated of stainless steel. Similarly, the annular spacers should be fabricated of either stainless steel or a chemically inert plastic capable of withstanding the pressures generated within the cylinder. The amount of mixing is determined by the length of the cylinder and the number of hollow spheres contained therewithin. Where large volumes of liquids or liquid solids must be mixed, the diameter of the cylinder and the corresponding diameter of the spheres may be increased in size.

A typical small scale device of this invention would comprise $1\frac{3}{4}$ inch stainless steel tubing fitted with twelve $1\frac{5}{8}$ inch O.D. polyethylene hollow spheres which contain twenty-six $\frac{1}{4}$ inch holes using annular spacers of approximately 1 inch in length. This gives adequate mixing to two liquids at a flow rate of 25 gals. per minute.

Having thus described my invention, it is claimed as follows:

1. A static mixing device for mixing a plurality of fluent materials comprising, a hollow cylindrical housing having an inlet and an outlet, and a plurality of hollow spherical mixing members within said housing having outer diameters slightly less than the interior diameter of said housing, each of said mixing members not being connected to said housing, each said mixing member having a large number of openings for fluent material flow, whereby the fluent materials flow through the hollow spherical mixing members between the inlet and outlet.

2. The static mixing device of claim 1, wherein spacers are provided within said housing spacing apart said hollow spherical mixing members.

3. The static mixing device of claim 2, wherein the spacers are annular.

4. The static mixing device of claim 1, wherein the hollow spherical mixing members are of resilient material.

* * * * *